US012274370B2

(12) United States Patent
Yang et al.

(10) Patent No.: US 12,274,370 B2
(45) Date of Patent: Apr. 15, 2025

(54) ASSEMBLY STRUCTURE OF CHAIR

(71) Applicants: Teng-Jen Yang, Taichung (TW); Yuan-Ta Yang, Taichung (TW)

(72) Inventors: Teng-Jen Yang, Taichung (TW); Yuan-Ta Yang, Taichung (TW)

( * ) Notice: Subject to any disclaimer, the term of this patent is extended or adjusted under 35 U.S.C. 154(b) by 164 days.

(21) Appl. No.: 18/126,375

(22) Filed: Mar. 24, 2023

(65) Prior Publication Data

US 2024/0315455 A1 Sep. 26, 2024

(51) Int. Cl.
*A47C 4/02* (2006.01)
*A47C 7/02* (2006.01)
*A47C 7/42* (2006.01)

(52) U.S. Cl.
CPC ..... *A47C 4/02* (2013.01); *A47C 7/0213* (2018.08); *A47C 7/42* (2013.01)

(58) Field of Classification Search
CPC ..... A47C 4/02; A47C 7/0213; A47C 4/03; A47C 7/42
See application file for complete search history.

(56) References Cited

U.S. PATENT DOCUMENTS 3,528,096 A * 9/1970 Moberg ..... A47C 13/00 297/118
8,882,201 B2 * 11/2014 Gorza ..... A47C 4/03 297/440.22

FOREIGN PATENT DOCUMENTS

EP 0241628 A1 * 10/1987
EP 1042976 A1 * 10/2000 ..... A47C 3/00
TW 099211901 2/2011

* cited by examiner

*Primary Examiner* — Milton Nelson, Jr.
(74) *Attorney, Agent, or Firm* — Bruce Stone LLP; Joseph A. Bruce

(57) ABSTRACT

An assembly structure of a chair includes: a chair frame having a front bar, a rear bar, a first side bar and a second side bar; and a chair seat detachably assembled with the chair frame and having a seat portion, a front engaging portion disposed at a front end of the seat portion to engage with the front bar, a rear engaging portion disposed at a rear end of the seat portion to engage with the rear bar, a first abutting portion disposed at one side of the seat portion to engage with and abut against the first side bar, and a second abutting portion disposed at another side of the seat portion to engage with and abut against the second side bar.

8 Claims, 8 Drawing Sheets

ASSEMBLY STRUCTURE OF CHAIR

BACKGROUND OF THE INVENTION

Field of Invention

The invention is related to chairs, and more particularly to an assembly structure of a chair.

Description of Related Art

Generally, a chair is mainly composed of a chair frame and a chair seat. The most common way is to dispose a plastic or wooden chair seat on a chair frame constituted by metal tubes by fastening the chair seat on the chair frame with a plurality of screws and a screwdriver, such as the chair shown in the Patent Application No. TW099211901 of the Republic of China. However, the assembling method and design of using tools and screws to lock the chair seat on the chair frame not only are time-consuming and laborious, but also cause the screws to easily loosen and fall off due to the long-term action of external force, resulting in future repairing trouble.

SUMMARY OF THE INVENTION

An objective of the present invention is to provide an assembly structure of a chair, which mainly enhances the convenience of assembling the chair.

Another objective of the present invention is to provide an assembly structure of a chair, whereby no screw is required so that troubles caused by the loosening of screws can be prevented.

In order to achieve the aforementioned objectives, the present invention provides an assembly structure of a chair, which includes: a chair frame having a first side frame, a second side frame facing the first side frame, a front bar connected to and located between the first side frame and the second side frame, and a rear bar connected to and located between the first side frame and the second side frame and facing the front bar, the first side frame having a first side bar located between the front bar and the rear bar, and the second side frame having a second side bar located between the front bar and the rear bar and facing the first side bar; and a chair seat detachably assembled with the chair frame and provided with a seat portion, a front engaging portion disposed at a front end of the seat portion and configured to engage with the front bar, a rear engaging portion disposed at a rear end of the seat portion and configured to engage with the rear bar, a first abutting portion disposed at one side of the seat portion and configured to abut against the first side bar, and a second abutting portion disposed at another side of the seat portion and configured to abut against the second side bar.

Technical effects of the present invention lie as follows. Through the structures of the front bar, the rear bar, the first side bar and the second side bar of the chair frame in conjunction with the design of the front engaging portion, the rear engaging portion, the first abutting portion and the second abutting portion of the chair seat, the chair seat and the chair frame of the present invention can be assembled with each other by only engaging the front engaging portion and the rear engaging portion of the chair seat with the front bar and the rear bar of the chair frame respectively. Moreover, the first abutting portion and the second abutting portion of the chair seat are respectively engaged with the first side bar and the second side bar of the chair frame to enhance the stability of assembly of the chair seat and the chair frame. Therefore, the chair frame can be assembled with the chair seat without any tools and screws, which can enhance the convenience of assembling a chair and avoid troubles caused by the loosening of screws during assembling.

Optionally, the front engaging portion of the chair seat has a front engaging groove for engaging with the front bar, the rear engaging portion of the chair seat has a rear engaging groove for engaging with the rear bar, and the rear engaging groove and the front engaging groove face toward different directions.

Optionally, the front engaging portion of the chair seat is elongated, and the front engaging groove faces obliquely forward relative to a bottom side of the chair.

Optionally, the number of rear engaging portions of the chair seat is three, and each of the rear engaging grooves faces obliquely backward relative to a bottom side of the chair.

Optionally, the first abutting portion of the chair seat has a first abutting groove for abutting against the first side bar, the second abutting portion of the chair seat has a second abutting groove for abutting against the second side bar, and both the first abutting groove and the second abutting groove face downward.

Optionally, the chair frame further has two support bars disposed on the rear bar, the chair seat further has two engaging members disposed on the rear end of the seat portion, the assembly structure of the chair further has a chair back for being detachably assembled with the chair frame and the chair seat, the chair back has a backrest, two support sleeving portions disposed on two sides of the backrest and configured to be respectively sleeved on the support bars, and two engaging ring portions respectively disposed on the support sleeving portions and configured to detachably engage with the engaging members of the chair seat.

Optionally, each of the two support bars of the chair frame has a horizontal portion fixed on the rear bar and a vertical portion connected to the horizontal portion and extending upward, and each of the two support sleeving portions of the chair back has a sleeving recess for being sleeved on the vertical portion.

Optionally, each of the two engaging ring portions of the chair back extends transversely and has an engaging hole, and each of the two engaging members of the chair seat has an engaging bulge for inserted into the engaging hole.

Optionally, the chair back further has two locking recesses connected to the engaging ring portions, and the chair seat further has two engaging protrusions connected to the engaging members and configured to engage with the locking recesses.

DETAILED DESCRIPTION OF THE INVENTION

Figure 1:
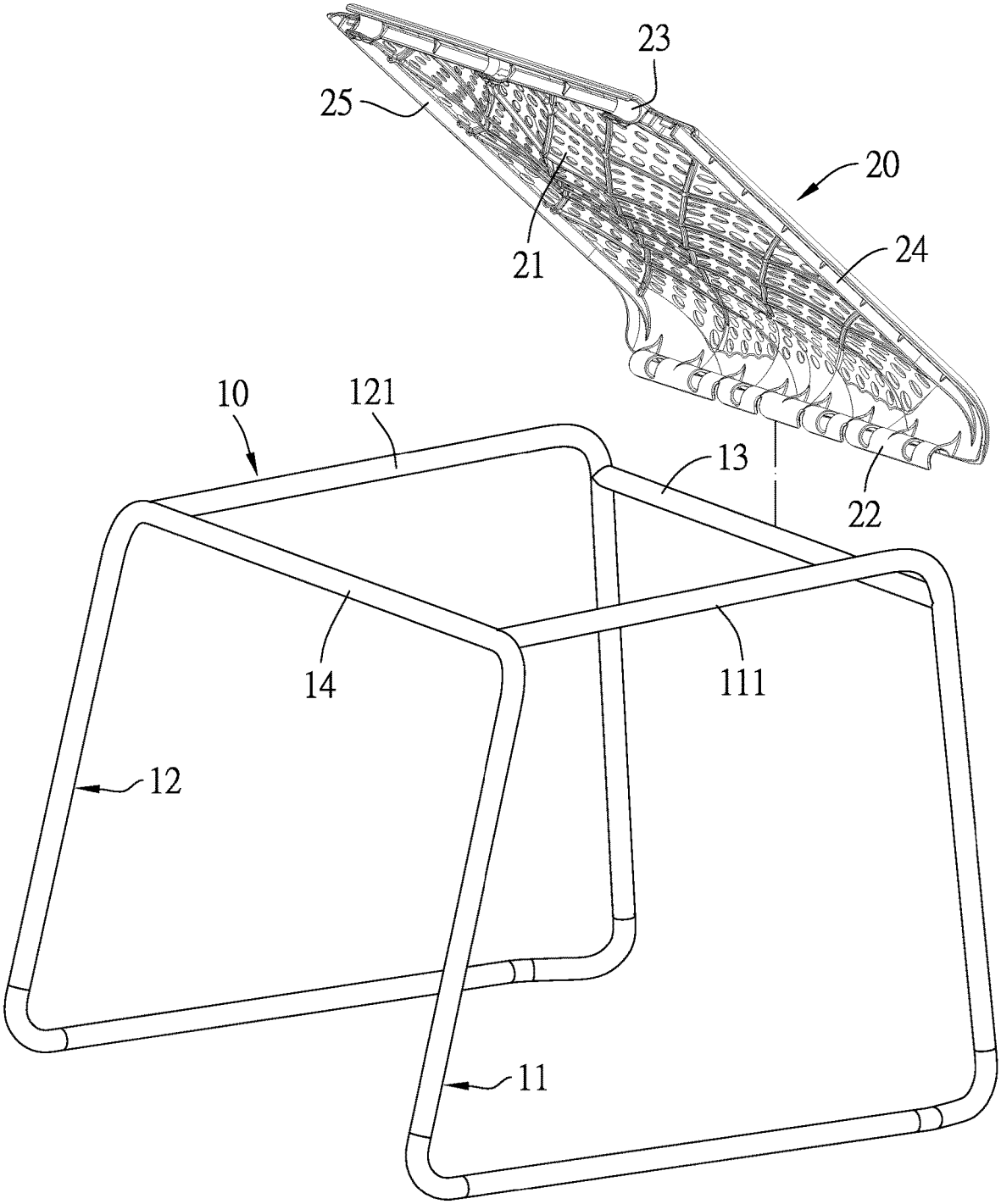
FIG. 1 is an exploded view of a first embodiment of the present invention.

Before presenting detailed descriptions, it should be noted that in the following descriptions, similar components and parts are represented by the same numbers. The directional terms mentioned in each of the following embodiments, for example: up, down, above, below, left, right, front or back, etc., are merely directions for referring to the attached drawings. Therefore, the directional terms used in the embodiments are used to illustrate rather than limit the invention.

Please refer to FIG. 1 to FIG. 4, an assembly structure of a chair provided by a first embodiment of the present invention is mainly composed of a chair frame 10 and a chair seat 20.

The chair frame 10 is formed by bending metal round tubes, and has a first side frame 11, a second side frame 12 facing the first side frame 11, a front bar 13 connected to and located between the first side frame 11 and the second side frame 12, and a rear bar 14 connected to and located between the first side frame 11 and the second side frame 12 and facing the front side bar 13. The first side frame 11 has a first side bar 111 located between the front bar 13 and the rear bar 14. The second side frame 12 has a second side bar 121 located between the front bar 13 and the rear bar 14 and facing the first side bar 111. The front bar 13, the rear bar 14, the first side bar 111 and the second side bar 121 of the chair frame 10 approximately form a rectangular shape at a top view.

The chair seat 20 is made of plastic, can be detachably assembled with the chair frame 10, and is provided with an approximate rectangular seat portion 21, a front engaging portion 22 disposed at a front end of the seat portion 21 and configured to engage with the front bar 13, a rear engaging portion 23 disposed at a rear end of the seat portion 21 and configured to engage with the rear bar 14, a first abutting portion 24 disposed at one side of the seat portion 21 and configured to abut against the first side bar 111, and a second abutting portion 25 disposed at another side of the seat portion 21 and configured to abut against the second side bar 121. In this embodiment, the front engaging portion 22 of the chair seat 20 is elongated, the front engaging portion 22 has a front engaging groove 221 for engaging with the front bar 13, a cross section of the front engaging groove 221 is approximately C-shaped, and the front engaging groove 221 faces obliquely forward relative to the bottom side of the chair; the number of rear engaging portions 23 of the chair seat 20 is three, each of the rear engaging portions 23 correspondingly has a rear engaging groove 231 for engaging with the rear bar 14, a cross section of each of the rear engaging grooves 231 is approximately C-shaped, the respective rear engaging groove 231 and the front engaging groove 221 face toward different directions, and each of the rear engaging grooves 231 faces obliquely backward relative to the bottom side of the chair; and the first abutting portion 24 of the chair seat 20 has a first abutting groove 241 for abutting against the first side bar 111, the second abutting portion 25 of the chair seat 20 has a second abutting groove 251 for abutting against the second side bar 121, and both the first abutting groove 241 and the second abutting groove 251 face downward.

The above is the description of the main components of the first embodiment of the present invention. The operation and technical effects of the present invention are described as follows.

Figure 2:
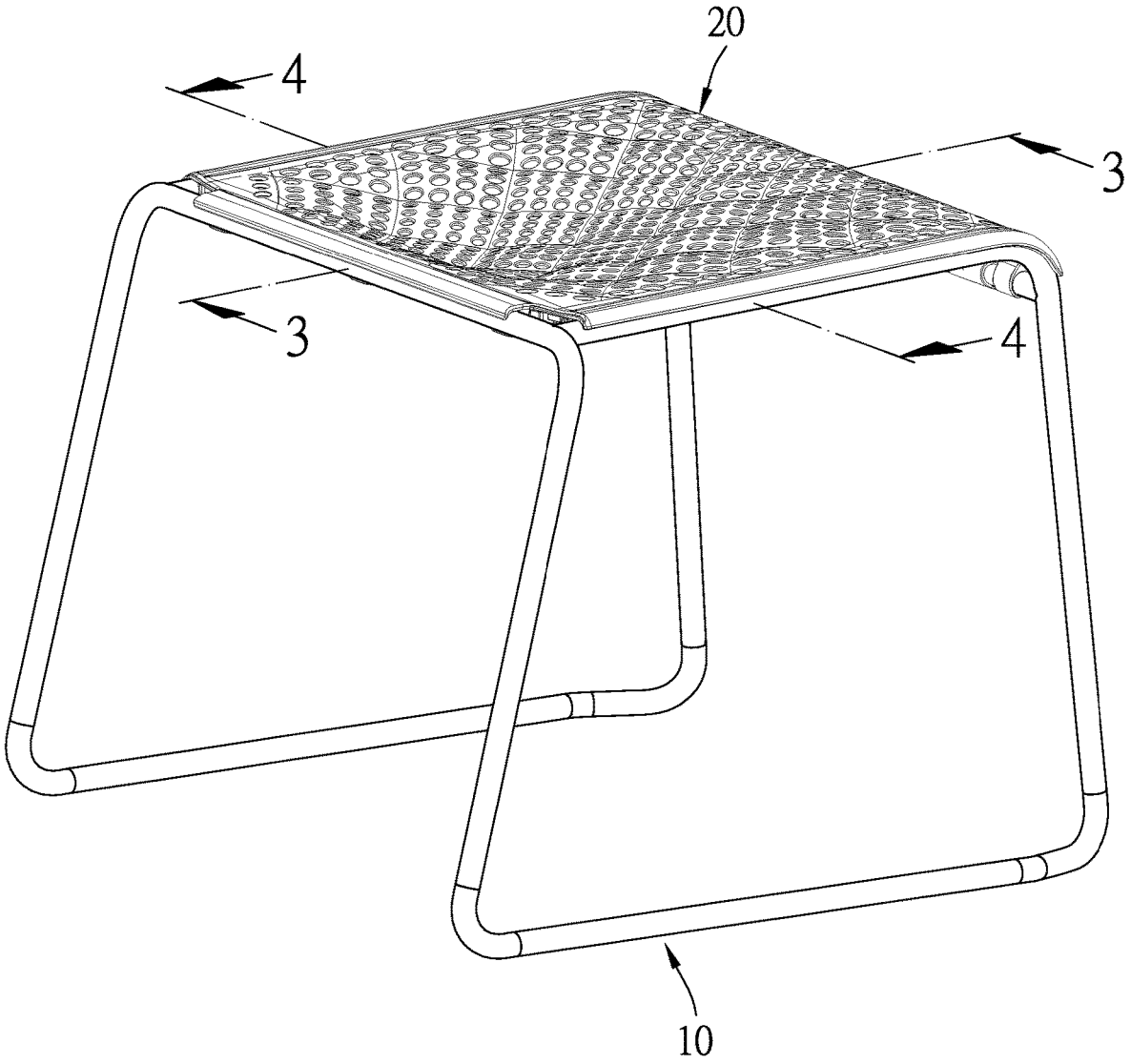
FIG. 2 is a perspective view of the first embodiment of the present invention.
Figure 3:
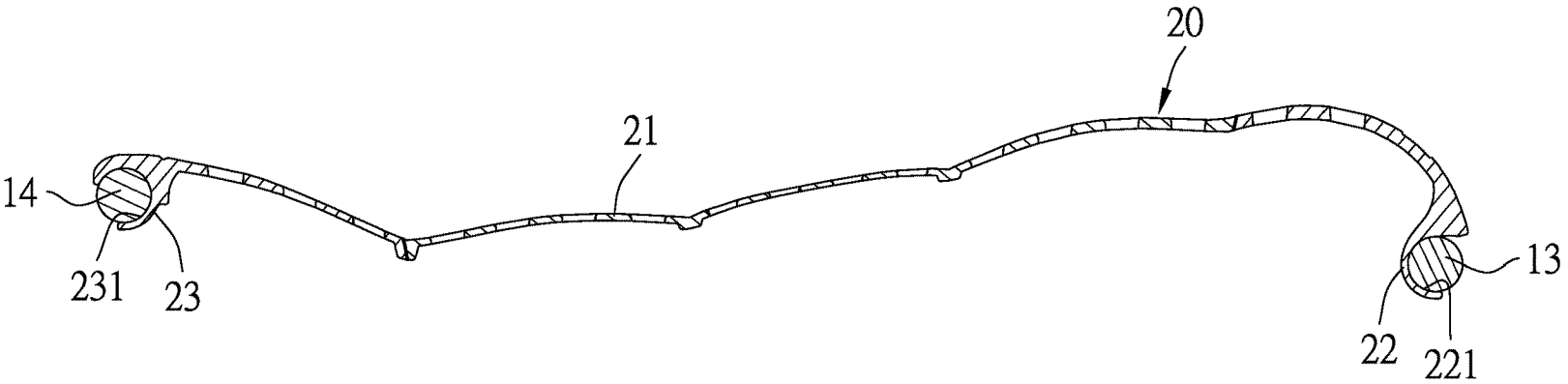
FIG. 3 is a cross-sectional view along a line segment 3-3 in FIG. 2.
Figure 4:
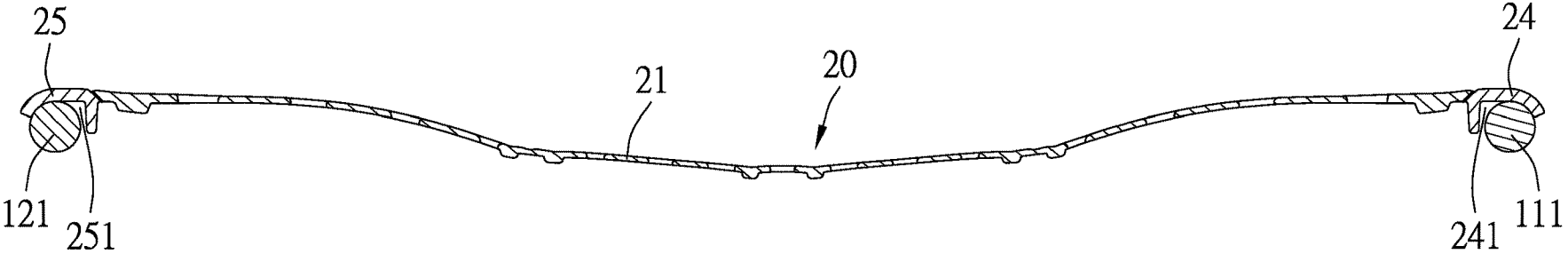
FIG. 4 is a cross-sectional view along a line segment 4-4 in FIG. 2.
Figure 5:
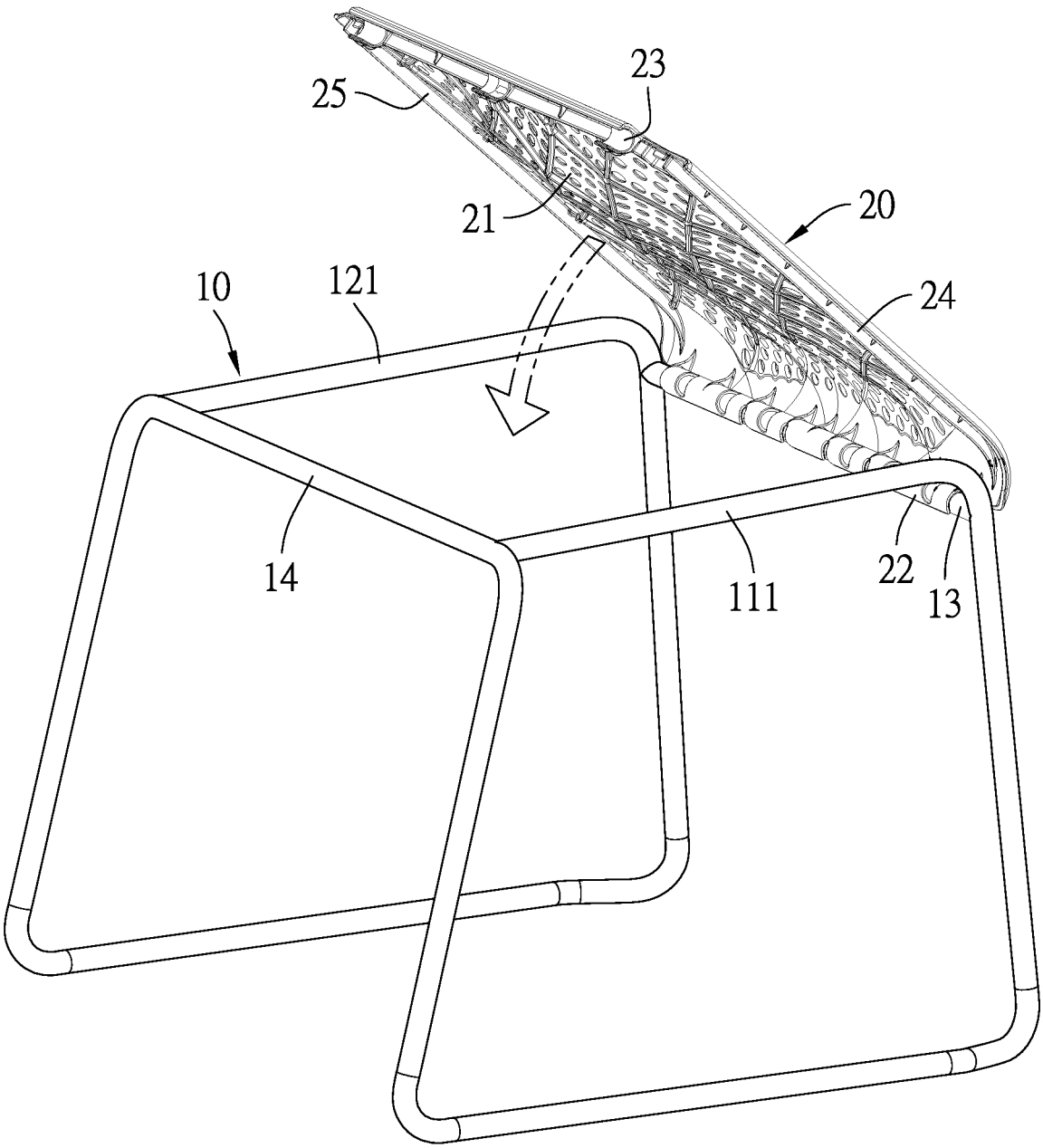
FIG. 5 is a schematic view of the assembling of the first embodiment of the present invention showing engaging a front engaging portion of a chair seat with a front bar of a chair frame.
Figure 6:
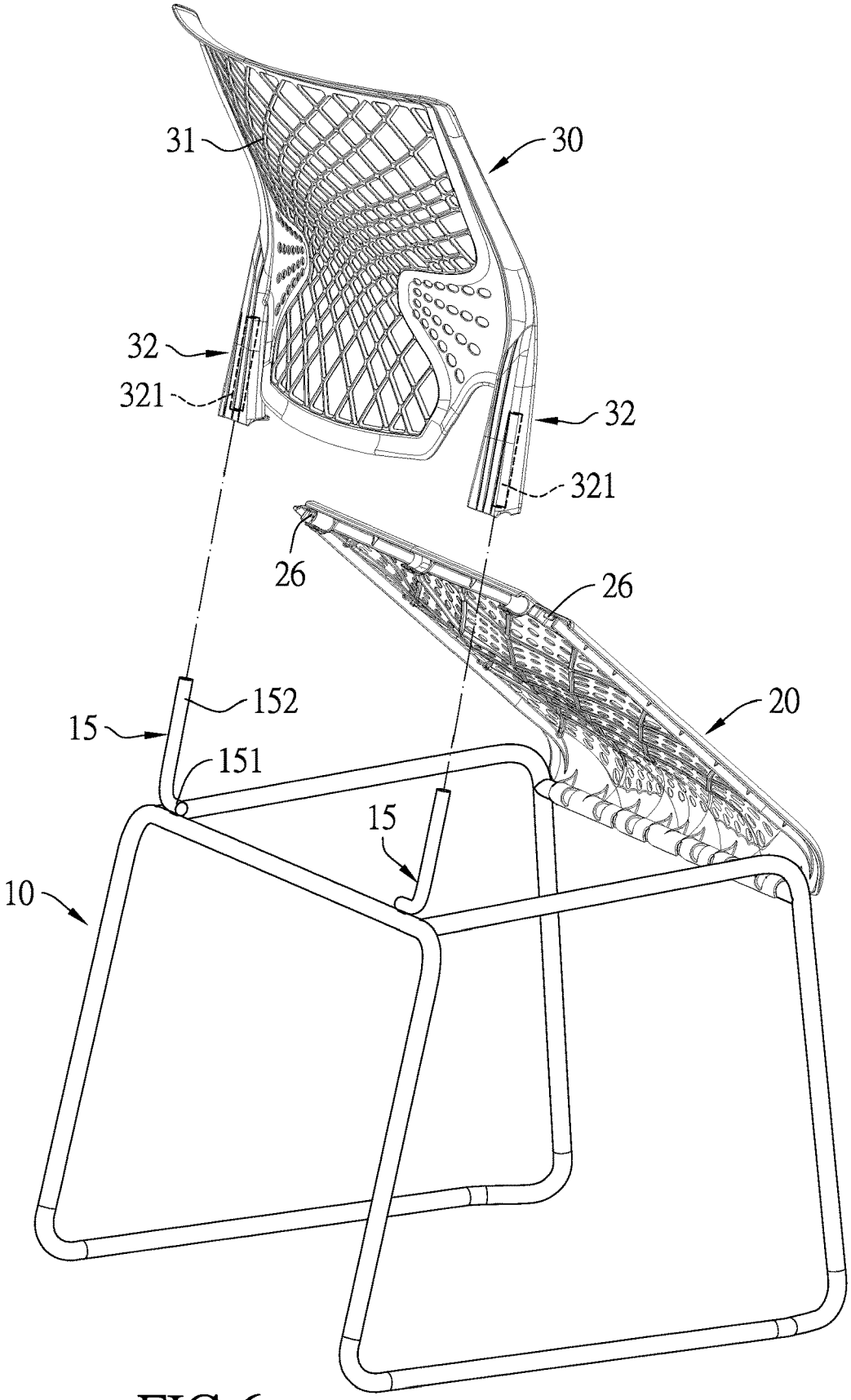
FIG. 6 is an exploded view of a second embodiment of the present invention.
Figure 7:
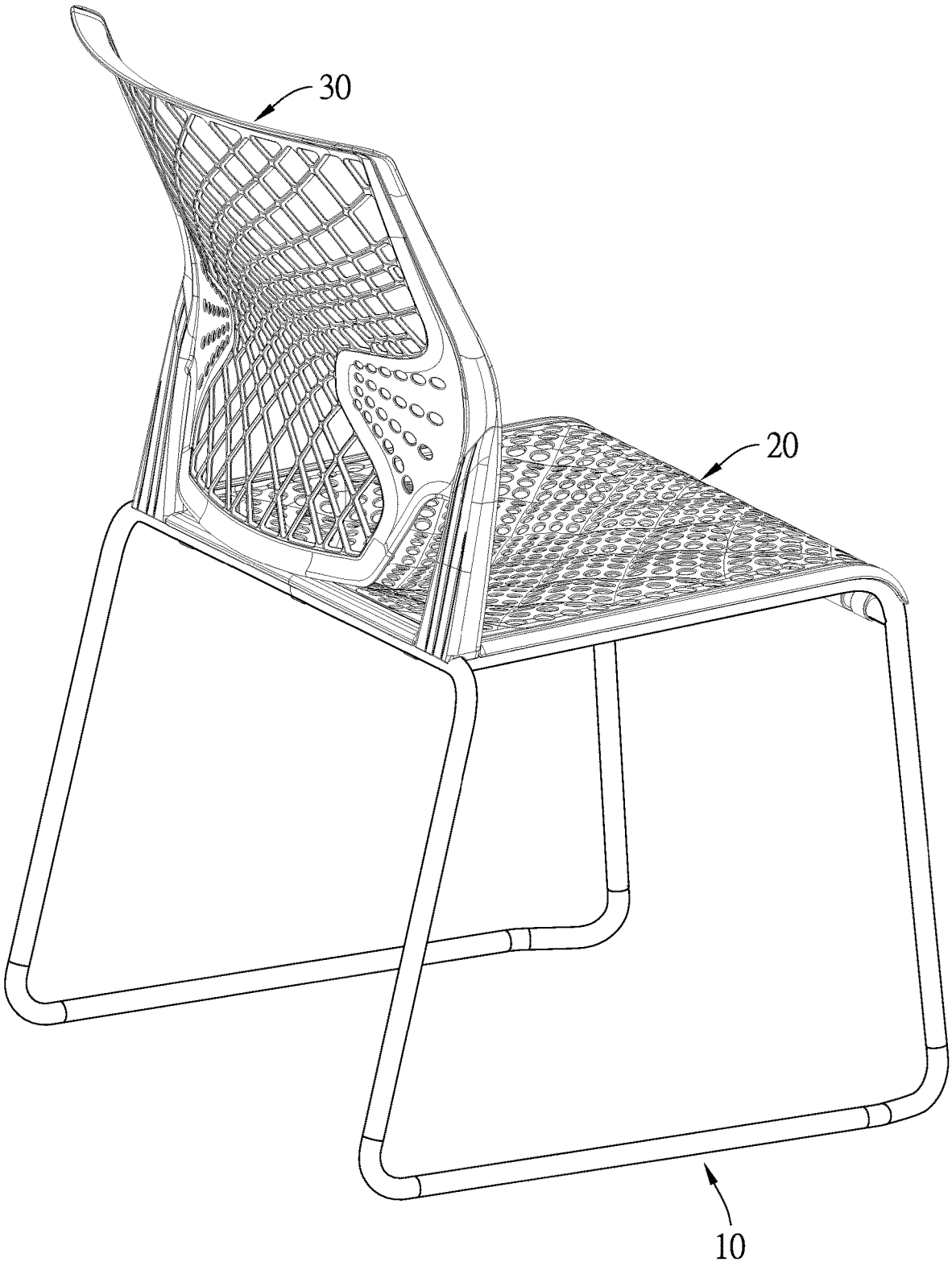
FIG. 7 is a perspective view of the second embodiment of the present invention.
Figure 8:
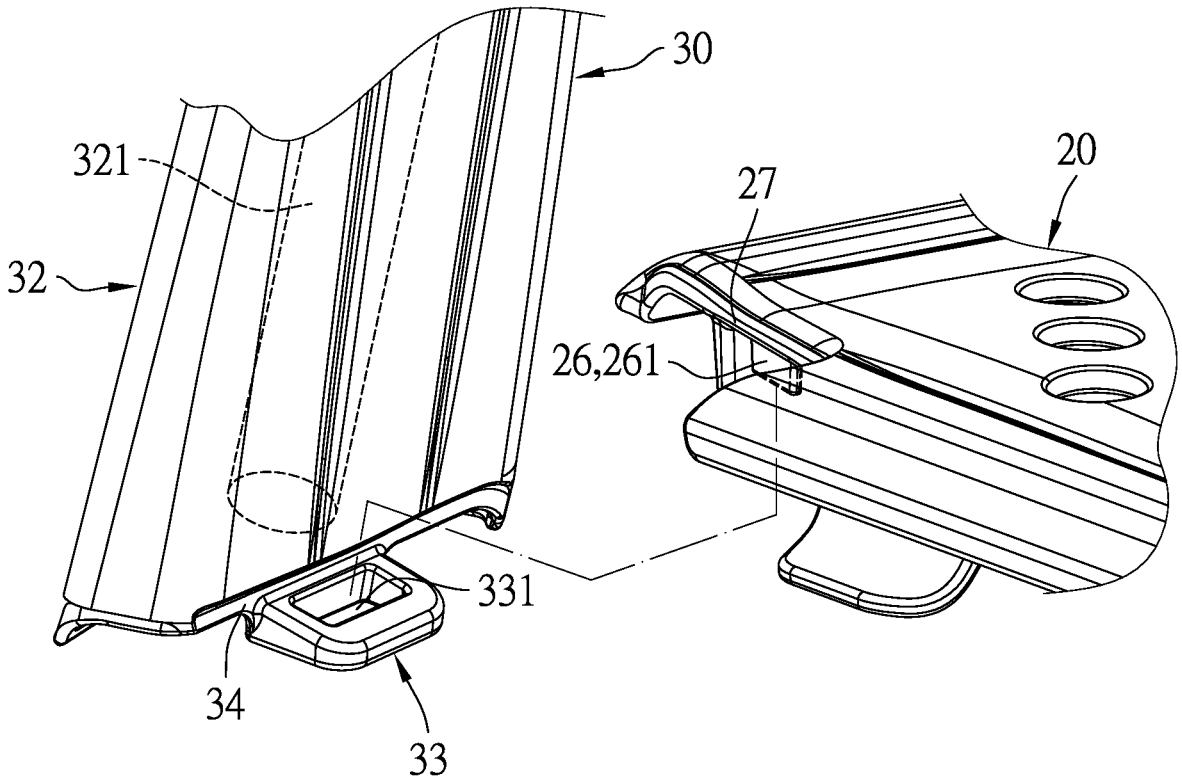
FIG. 8 is a partially enlarged view of the second embodiment of the present invention showing that an engaging member and an engaging protrusion of the chair seat are respectively separated from an engaging ring portion and a locking recess of a chair back.
Figure 9:
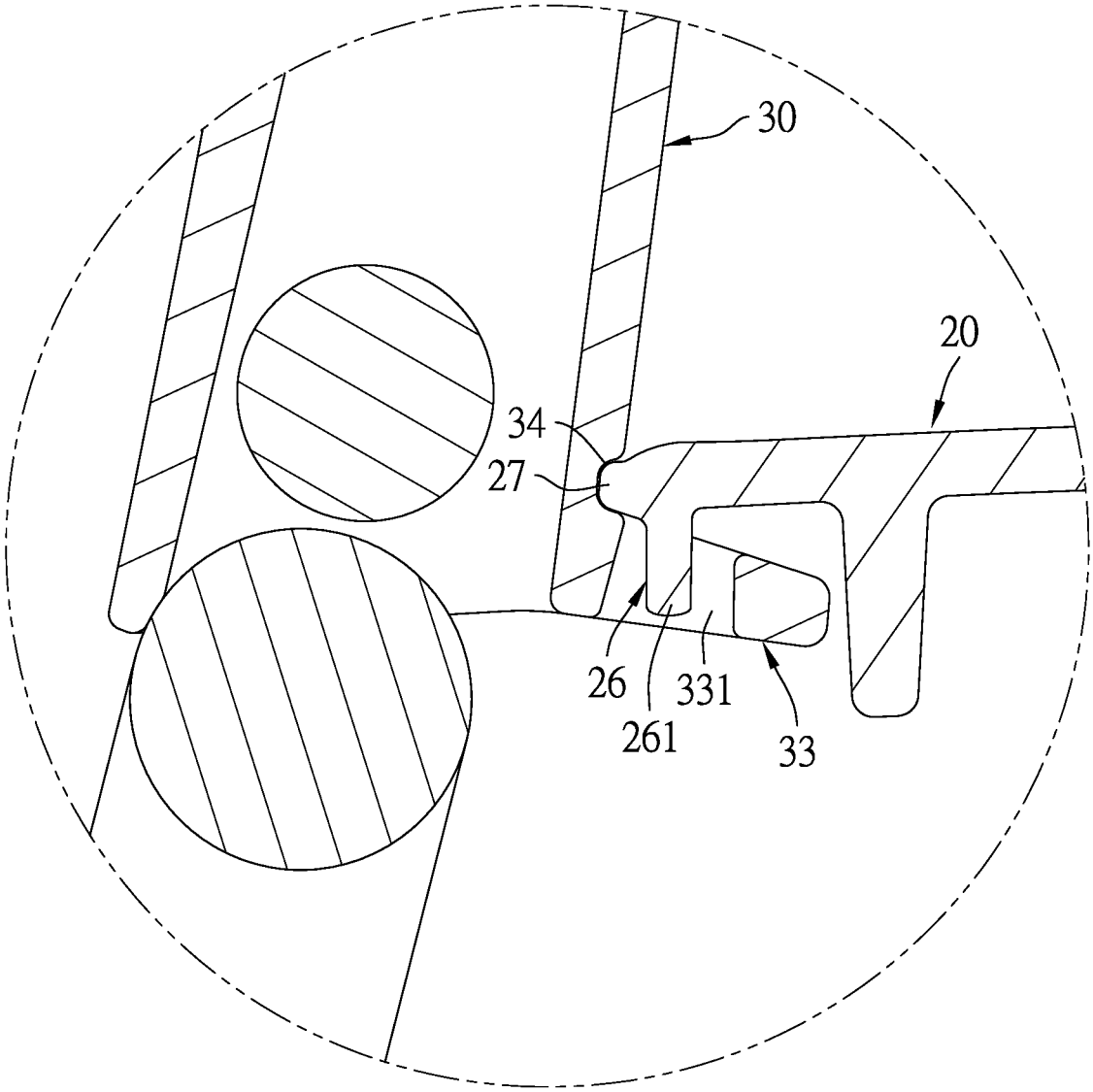
FIG. 9 is a partially enlarged view of the second embodiment of the present invention showing a cross-section in which the engaging member and the engaging protrusion of the chair seat are respectively engaged with the engaging ring portion and the locking recess of the chair back.

Please refer to FIGS. 1, 5 and 2, in the process of assembling the chair seat 20 with the chair frame 10 in the present invention, first align the front engaging portion 22 of the chair seat 20 with the front bar 13 of the chair frame 10 and engage the front engaging portion 22 with the front bar 13, and then pivot the chair seat 20 downwards on the front bar 13 by an angle to engage each of the rear engaging portions 23 of the chair seat 20 with the rear bar 14 of the chair frame 10 and at the same time, respectively engage the first abutting portion 24 and the second abutting portion 25 of the chair seat 20 with the first side bar 111 and the second side bar 121 of the chair frame 10. In this way, the assembling of the chair is completed.

Accordingly, through the structures of the front bar 13, the rear bar 14, the first side bar 111 and the second side bar 121 of the chair frame 10 and the design of the front engaging portion 22, the rear engaging portions 23, the first abutting portion 24 and the second abutting portion 25 of the chair seat 20, the chair seat 20 can be assembled with the chair frame 10 by only engaging the front engaging portion 22 and the rear engaging portions 23 of the chair seat 20 with the front bar 13 and the rear bar 14 of the chair frame 10 respectively. Moreover, the first abutting portion 24 and the second abutting portion 25 of the chair seat 20 are respectively engaged with the first side bar 111 and the second side bar 121 of the chair frame 10 to enhance the stability of assembly of the chair seat 20 and the chair frame 10 and also increase a load-bearing capacity. Therefore, the chair frame 10 can be assembled with the chair seat 20 without any tools and screws, which can enhance the convenience of assembling a chair and avoid troubles caused by the loosening of screws during assembling.

Please refer to FIG. 6 to FIG. 9 for an assembly structure of a chair provided by a second embodiment of the present invention, and differences between the second embodiment and the first embodiment are described below.

The chair frame 10 further has two support bars 15 disposed on the rear bar 14, and each of the support bars 15 is approximately L-shaped and has a horizontal portion 151 fixed on the rear bar 14, and a vertical portion 152 connected to the horizontal portion 151 and extending upward.

The assembly structure of the chair further has a chair back 30 that can be detachably assembled with the chair frame 10 and the chair seat 20, and the chair back 30 has a backrest 31, two support sleeving portions 32 disposed on two sides of the backrest 31 and configured to be respectively sleeved on the support bars 15, two engaging rings 33 respectively disposed on the support sleeving portions 32, and two locking recesses 34 respectively connected to the engaging rings 33; in this embodiment, each of the two support sleeving portions 32 of the chair back 30 has a sleeving recess 321 for being sleeved on the vertical portion 152; and furthermore, each of the two engaging ring portions 33 of the chair back 30 extends transversely toward the front bar 13 of the chair frame 10 and has an engaging hole 331, and the locking recesses 34 also face toward the front bar 13 of the chair frame 10.

The chair seat 20 further has two engaging members 26 disposed on the rear end of the seat portion 21, the two engaging members 26 can be detachably connected to the engaging ring portions 33 of the chair back 30, and each of the two engaging members 26 has an engaging bulge 261 for being inserted into the engaging hole 331, and two engaging protrusions 27 connected to the engaging members 26 and configured to engage with the locking recesses 34.

Accordingly, the chair back 30 and the chair frame 10 are positioned by each other not only by inserting the support bars 15 of the chair frame 10 into the support sleeving portions 32, but also by inserting the engaging members 26 of the chair seat 20 into the engaging ring portions 33 of the chair back 30 and engaging the engaging protrusions 27 of the chair seat 20 with the locking recesses 34 of the chair back 30. Therefore, the chair back 30 can be firmly assembled with the chair frame 10 and the chair seat 20, and the chair back 30 can also be detached from the chair frame 10 and the chair seat 20. It can be known that in the second embodiment of the present invention, the chair seat 20, the chair frame 10 and the chair back 30 can be assembled with one another without any tools and screws, which can enhance the convenience of assembling a chair and avoid troubles caused by the loosening of screws during assembling.

Although the specific embodiments of the invention are disclosed in the above implementation modes, they are not intended to limit the invention. The specification relating to the above embodiments should be construed as exemplary rather than as limitative of the invention, with many variations and modifications being readily attainable by a person having ordinary skill in the art to which the invention pertains without departing from the principles and spirit thereof as defined by the appended claims and their legal equivalents.

What is claimed is:

1. An assembly structure of a chair, comprising:

a chair frame having a first side frame, a second side frame facing the first side frame, a front bar connected to and located between the first side frame and the second side frame, and a rear bar connected to and located between the first side frame and the second side frame and facing the front bar, the first side frame having a first side bar located between the front bar and the rear bar, and the second side frame having a second side bar located between the front bar and the rear bar and facing the first side bar; and a chair seat detachably assembled with the chair frame and provided with a seat portion, a front engaging portion disposed at a front end of the seat portion and configured to engage with the front bar, a rear engaging portion disposed at a rear end of the seat portion and configured to engage with the rear bar, a first abutting portion disposed at one side of the seat portion and configured to engage with and abut against the first side bar, and a second abutting portion disposed at another side of the seat portion and configured to engage with and abut against the second side bar;

wherein the front engaging portion of the chair seat is elongated, and the front engaging groove faces obliquely forward relative to a bottom side of the chair.

2. The assembly structure of the chair as claimed in claim 1, wherein the front engaging portion of the chair seat has a front engaging groove for engaging with the front bar, the rear engaging portion of the chair seat has a rear engaging groove for engaging with the rear bar, and the rear engaging groove and the front engaging groove face toward different directions.

3. The assembly structure of the chair as claimed in claim 2, wherein the number of rear engaging portions of the chair seat is three, and each of the rear engaging grooves faces obliquely backward relative to a bottom side of the chair.

4. The assembly structure of the chair as claimed in claim 1, wherein the first abutting portion of the chair seat has a first abutting groove for engaging with and abutting against the first side bar, the second abutting portion of the chair seat has a second abutting groove for engaging with and abutting against the second side bar, and both the first abutting groove and the second abutting groove face downward.

5. The assembly structure of the chair as claimed in claim 1, wherein the chair frame further has two support bars disposed on the rear bar, the chair seat further has two engaging members disposed on the rear end of the seat portion, the assembly structure of the chair further has a chair back for being detachably assembled with the chair frame and the chair seat, the chair back has a backrest, two support sleeving portions respectively disposed on two sides of the backrest and configured to be respectively sleeved on the support bars, and two engaging ring portions respectively disposed on the support sleeving portions and configured to detachably engage with the engaging portions of the chair seat.

6. The assembly structure of the chair as claimed in claim 5, wherein the chair back further has two locking recesses connected to the engaging rings, and the chair seat further has two engaging protrusions connected to the engaging portions and configured to engage with the locking recesses.

7. The assembly structure of the chair as claimed in claim 5, wherein each of the two support bars of the chair frame has a horizontal portion fixed on the rear bar, and a vertical portion connected to the horizontal portion and extending upward, and each of the two support sleeving portions of the chair back has a sleeving recess for being sleeved on the vertical portion.

8. The assembly structure of the chair as claimed in claim 5, wherein each of the two engaging ring portions of the chair back extends transversely and has an engaging hole, and each of the two engaging portions of the chair seat has an engaging bulge for being inserted into the engaging hole.

* * * * *